United States Patent [19]

Wesson

[11] 4,004,539

[45] Jan. 25, 1977

[54] MARINE IMPLEMENT

[76] Inventor: Harry J. Wesson, 237 River St., Manistee, Mich. 49660

[22] Filed: Sept. 22, 1975

[21] Appl. No.: 616,160

[52] U.S. Cl. ..... 114/221 R; 43/5; 294/19 R; 294/24

[51] Int. Cl.[2] ..... B63B 21/04

[58] Field of Search ..... 114/221 R, 230; 294/19 R, 24; 43/5, 11, 12; 119/153

[56] References Cited

UNITED STATES PATENTS

| | | | |
|---|---|---|---|
| 1,852,629 | 4/1932 | Sturges | 114/230 |
| 3,150,460 | 9/1964 | Dees | 43/11 |
| 3,618,147 | 11/1971 | Gaskill | 7/1 H |
| 3,677,597 | 7/1972 | Stipek | 114/230 |
| 3,799,099 | 3/1974 | Conover | 114/221 R |

*Primary Examiner*—Trygve M. Blix
*Assistant Examiner*—Gregory W. O'Connor
*Attorney, Agent, or Firm*—Glenn B. Morse

[57] ABSTRACT

A boat hook is provided with a series of attachments engagable with a coupling device on the prod end. The coupling preferably includes a threaded section, and is set back from the point of the prod for the dual purpose of protecting the threads, and for utilizing the point as the means of assuring positive coaxial alignment of the coupling. The attachments provide a variety of areas of utility, and the preferred form of the invention has a telescoping handle capable of being locked in a plurality of degrees of extension appropriate to the particular attachments that may be coupled to the basic device. The original utility of the boat hook is not impaired by the provision for the attachments. One of the attachments is a hoop with a provision for temporarily retaining a loop in a mooring line.

7 Claims, 14 Drawing Figures

21
20
23
22
31

27
21
24
25
23
26
28
29
22

48
46
49
47

46
47

30
34
33
32

38
37
36
35
44
39

35
45
40
41

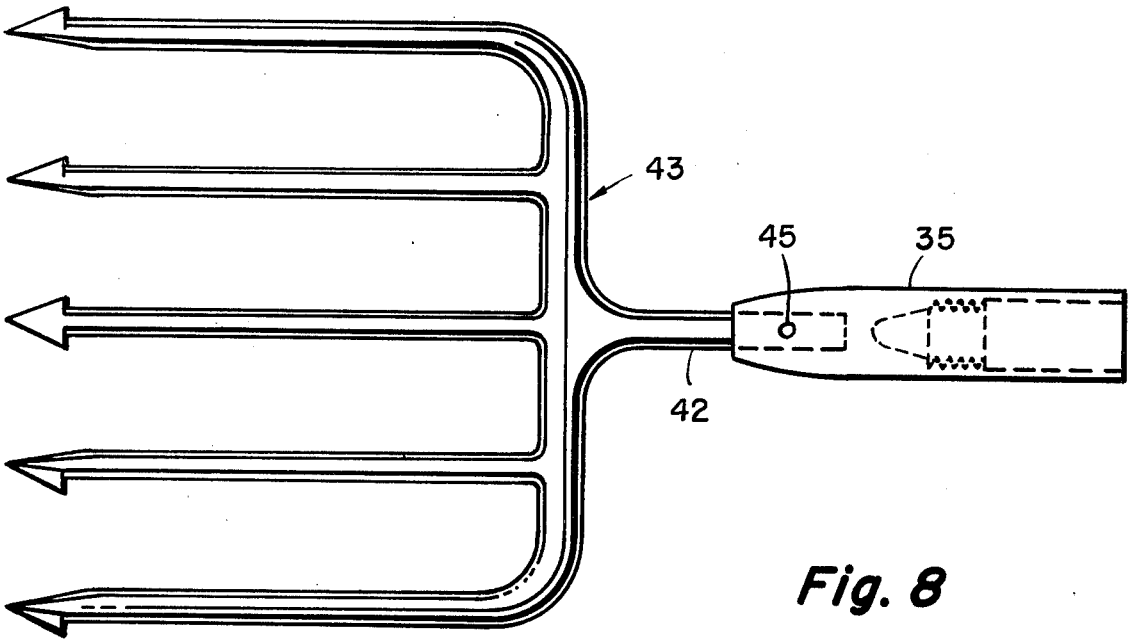
Fig. 8
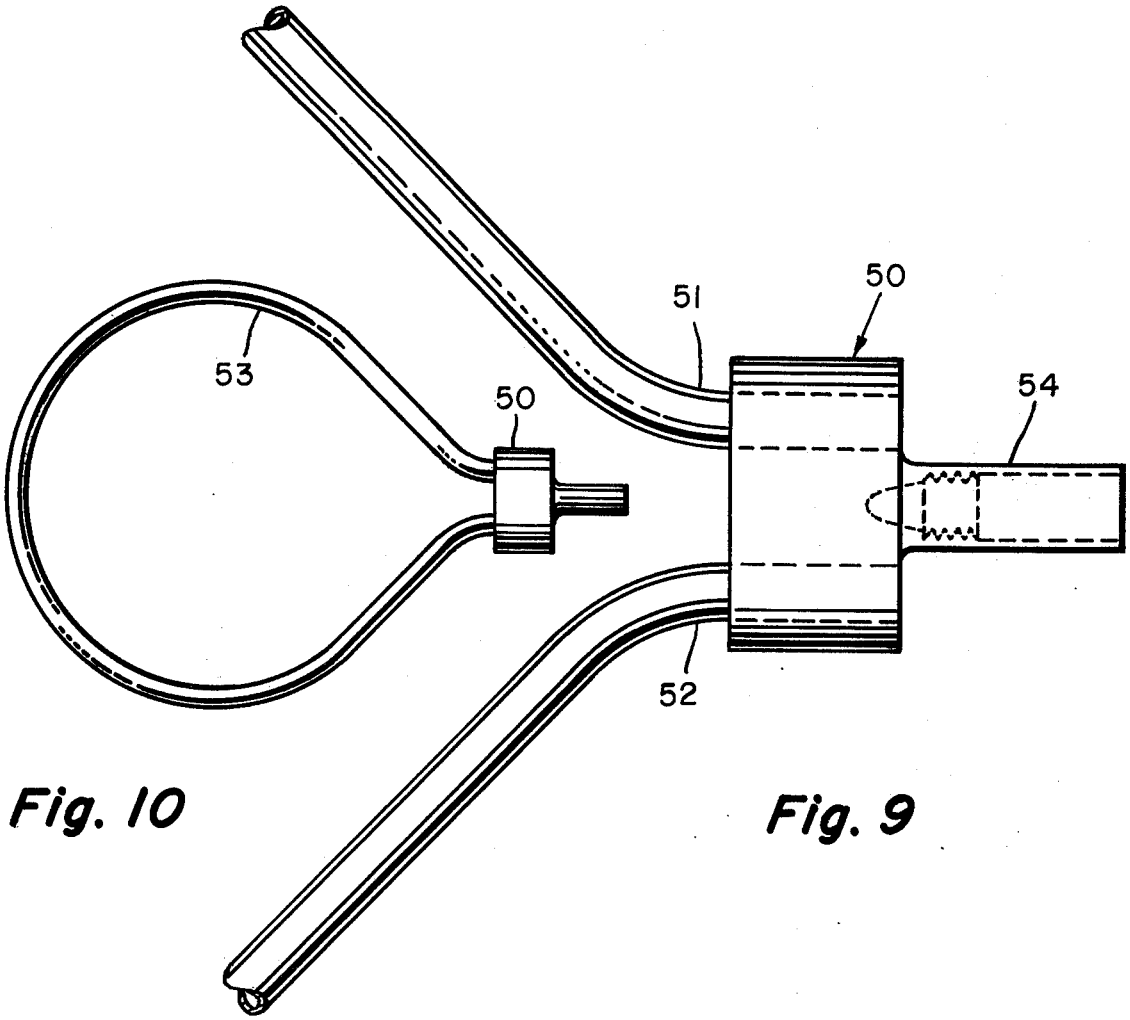
Fig. 10
Fig. 9

Fig. 11
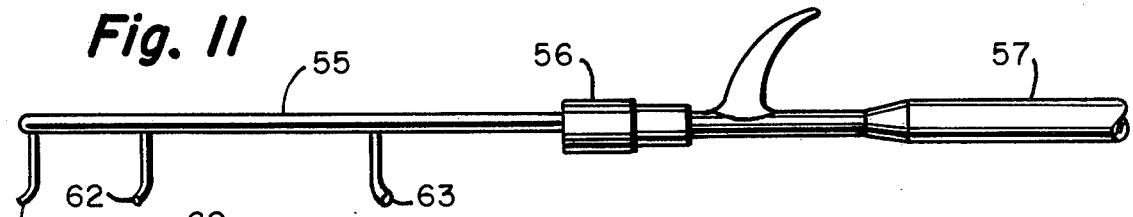
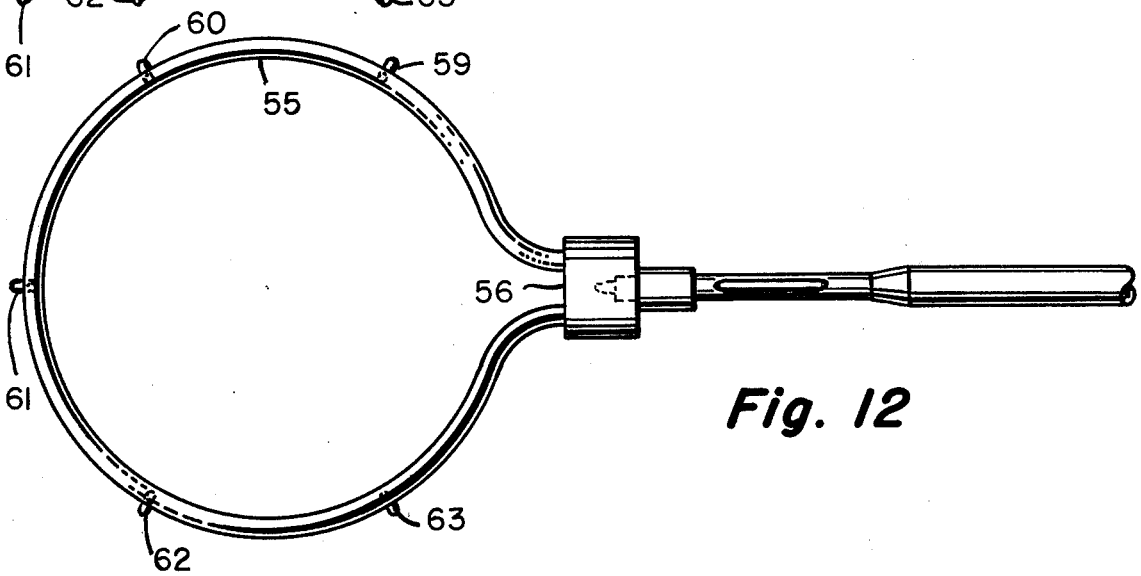
Fig. 12
Fig. 13
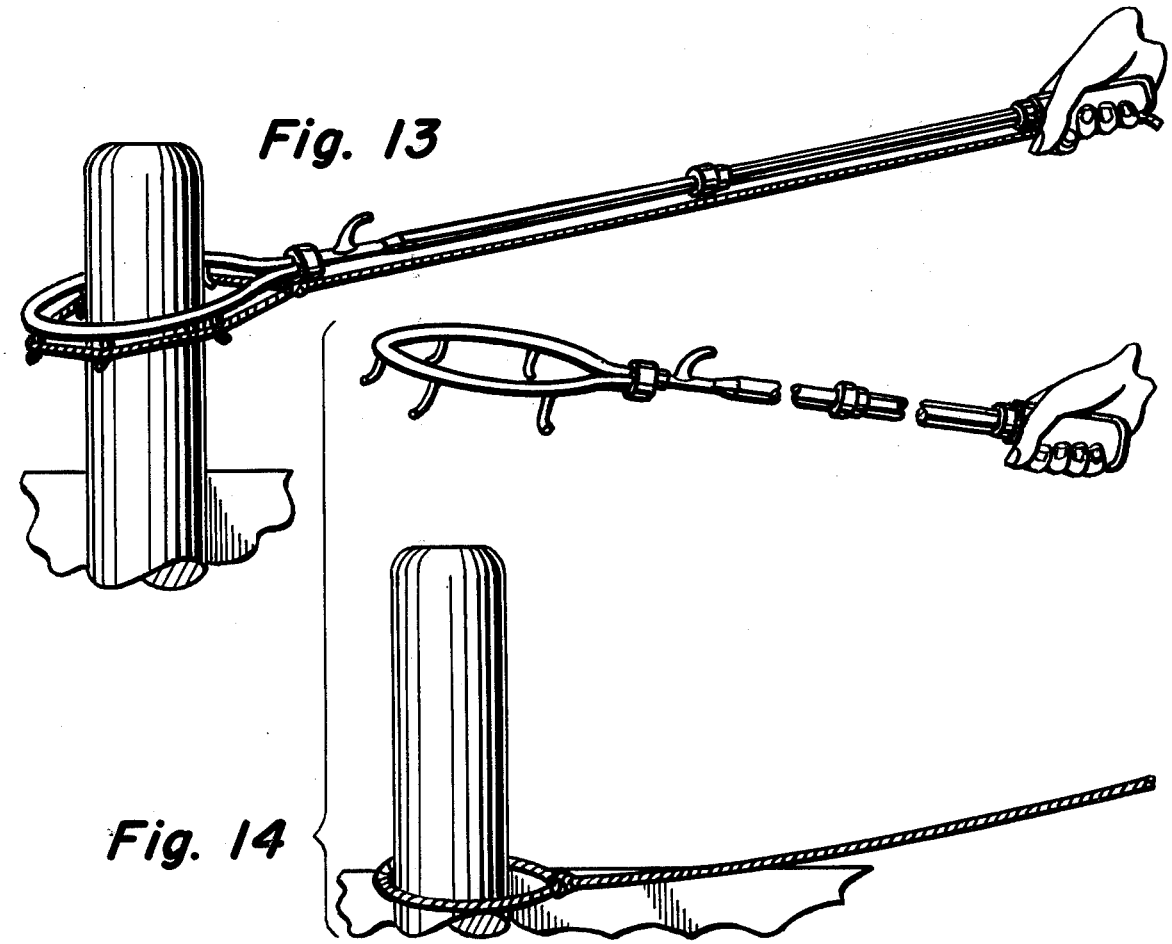
Fig. 14

MARINE IMPLEMENT

BACKGROUND OF THE INVENTION

The configuration of these boat hooks has been relatively standard for at least a hundred years. Essentially it includes an elongated handle and a head, with a hook extending laterally from head, and curved somewhat backward toward the handle. This configuration makes it possible for the user to get hold of a dock or piling, and pull his boat into position preparatory to attaching dock lines. The hook is sometimes pointed, which is the best configuration for use against piling, or it may be ball-ended where the operator is primarily interested in hooking onto other boats or objects that should not be scratched. A prod section normally extends coaxially with the handle, and on the opposite side of the handle from the hook. The prod is intended primarily to provide a push point that can be shoved into piling or dock timbers to shove the boat away from the dock, or move it around in close quarters.

SUMMARY OF THE INVENTION

The present invention utilizes the standard configuration of a boat hook as a basic tool, and provides coupling means for securing a number of attachments to this basic tool to provide a vastly widened area of utility. In the preferred form of the invention, the prod end of the boat hook has a coupling centering in a threaded section set back from the point, and each of the attachments has a socket with an internal thread and a configuration fitting closely with that of the prod to assure the alignment of the attachment with respect to the basic device, and an effective transfer of stresses during its use. One form of the implement is a hoop provided with a handle and means for retaining a loop of a mooring line.

DESCRIPTION OF THE DRAWINGS

FIG. 8 is a plan view of the fish spear attachment.

FIG. 9 is a view of a coupling portion of a net frame.

FIG. 10 is a plan view, on a reduced scale over that of FIG. 9, showing the entire net frame.

FIG. 11 is a side elevation of a modified form of the invention.

FIG. 12 is a plan view of the device shown in FIG. 11.

FIG. 13 and 14 are a perspective views showing the use of the device shown in FIGS. 11 and 12.

DESCRIPTION OF THE PREFERRED EMBODIMENTS

Figures 1, 2, 3, 4, 5, 6, 7:
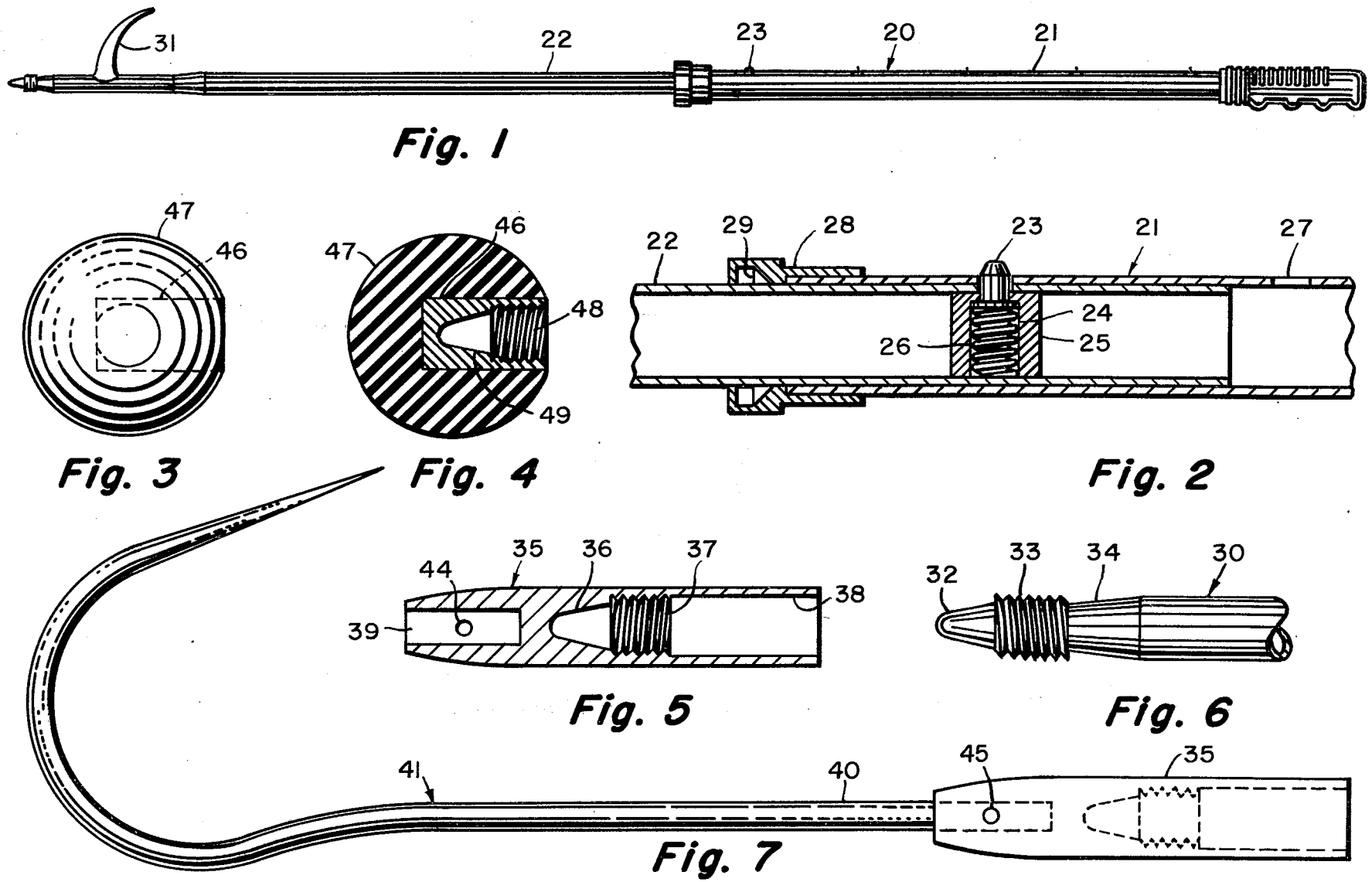
FIG. 1 is a side elevation of the basic implement, and condition for use as a conventional boat hook.
FIG. 2 is an axially section on an enlarged scale of the locking device securing the adjusted degree of extension of a telescoping handle section.
FIG. 3 is a side elevation on an enlarged scale over that of FIG. 1, showing the ball attachment.
FIG. 4 is an axial section of the ball attachment shown on FIG. 3.
FIG. 5 is an axial section through the socket portion of the gaff hook attachment shown in FIG. 7.
FIG. 6 is a side elevation showing the prod portion of the implement illustrated in FIG. 1.
FIG. 7 is a side elevation of the gaff hook attachment.

The basic implement illustrated in FIG. 1 includes a handle generally indicated at 20 including the outer and inner telescoping tubular sections 21 and 22, respectively. A transverse detent 23 is slideably mounted in the bore 24 of the plug 25 secured to the inner telescoping section 22 by the passage of the detent 23 through an appropriate opening in the wall of the inner section 22. A compression spring 26 applies a biasing action urging the detent 23 to the projected position shown in FIG. 2. The detent 23 is engageable with any one of a series of openings 27 in the wall of the outer handle section 21 to lock the desired degree of extension. A stop collar 28 is secured to the end of the outer handle section 21 by any convenient means, such as welding, capable of resisting substantial forces tending to pull the collar 28 off the end of the outer section 21. The stop collar 28 has an annular interior groove 29 providing a recess capable of receiving the end of the detent 23 in any relative angular position of the inner and outer tubular sections 21 and 22, and thus functioning as a stop limiting the degree of extension of these telescoping sections so that they cannot be completely pulled apart.

FIG. 6 illustrates a modification of the prod end of the basic implement, which is an area exhibiting a difference from standard configuration. A portion 30 extending on the opposite side of the hook portion 31 from the handle 20 terminates in a point 32. A threaded portion 33 is set back from the point 32, and a tapered portion 34 proceeds to an increase in diameter from that adjacent to the threaded portion 33.

The socket device shown in FIG. 5 is used in conjunction with the gaff hook illustrated in FIG. 7 and the fish spear shown in FIG. 8. The interior configuration of the socket includes a tapered section 36 conforming to the configuration of the point 32, and also includes a threaded section 37 engageable with the portion 33. The tubular section 38 may be of a diameter selected to fit relatively closely, but yet slide freely over the cylindrical portion of the prod 30. In the alternative, the interior surface 38 may be tapered for a relatively tight axial interengagement with the tapered surface indicated at 34 in FIG. 6, as the threaded sections 33 and 37 are rotated into engagement. In either case, the taper of the section 34 will tend to assure the coaxial alignment of the socket unit 35 with respect to the axis of the prod 30. The bore 39 at the extreme end of the socket unit receives either the cylindrical end 40 of the gaff hook 41, or the shank 42 of the fish spear shown in FIG. 8. In either case, a transverse hole 44 in the socket unit 35 can receive a locking pin 45 traversing both the socket and either the end 40 of the gaff hook or the shank 42 of the fish spear. Since the ball attachment shown in FIGS. 3 and 4 does not encounter forces tending to disturb the axial alignment of the attachment with respect to the axis of the handle, the metalic insert 46 in the rubber-like cushioning material 47 is provided only with the internal threads 48 and the configuration indicated at 49 for receiving the point 32. While this tapered interengagement at one axial side of the threads 48 is less positive in maintaining an alignment, it is entirely adequate for the ball-shaped configuration of this attachment.

The central head 50 of the net frame attachment shown in FIGS. 9 and 10 has parallel bores receiving the ends of 51 and 52 of the rod 53 with which netting material (not shown) is normally interengaged. The fitting 50 also has the socket section 54 providing an interior configuration similar to that shown in FIG. 5. The interengagement of this portion of the fitting with the prod of the basic implement is exactly the same as that discussed in connection with FIG. 5.

FIGS. 11 through 13 illustrate a device that is extremely useful in mooring procedures. A loop frame 55 terminates in a head 56 similar to the head 50 appearing in FIGS. 9 and 10. The handle assembly 57 interengages with this member in the manner previously described. A group of projections 59 – 63 extends on on side of the plane of the axis of the loop frame 55. These projections diverge from each other, and from the central area of the loop frame, with increased distance from this plane. A loop of rope, or "line" in the language of the sailor, may be slipped over the projections 59 – 63, and maintained in engagement with them by slight tension in the direction of the handle 57. The user of the device will normally hold the line in one of his hands as he is gripping the handle. The loop frame may be maneuvered over the top of a piling or a dock cleat, and first used to pull the boat into mooring position. Whenever he desires to transfer the forces to the rope, a slight relaxing of the tension will permit the loop to drop off the projections 59 – 63, and into engagement with the piling or cleat. In situations where the length of the projectin might interfere with engaging the loop frame with cleat, the device may initially be inverted for the initial application of tension to the handle. This will then normally be followed by reversing the position of the device to that illustrated in the drawings, so that the loop rope may be dropped over the cleat. FIG. 13 shows the manner in which the rope is retained in engagement with the implement.

I claim:

1. A marine implement including a boat hook having an elongated handle portion extending along a handle axis, a hook portin extending laterally from said axis, and a prod portion extending parallel to said axis on the opposite side of said hook portion from said handle portion, wherein the improvement comprises:

coupling means on said prod portion coaxial therewith, including a threaded portion, said prod portion having a point extending substantially beyond said coupling means; and at least one attachment engageable with said coupling means, and having a socket in which part of said prod portion is receivable.

2. An implement as defined in claim 1, wherein said socket receives said prod portion on both axial sides of said threaded portion.

3. An implement, as defined in claim 2, wherein said prod portion tapers to increased diameter from said threaded portion toward said hook portion.

4. A marine implement including a boat hook having an elongated handle portion extending along a handle axis, said handle portion having telescoping sections and locking means operable to secure at least two degrees of extension of said telescoping sections, said implement also including a hook portion extending laterally from said axis, and a prod portion extending parallel to said axis on the opposite side of said hook portion from said handle portion, wherein the improvement comprises:

coupling means on said prod portion coaxial therewith, said prod portion having a point extending substantially beyond said coupling means;

at least one attachment engageable with said coupling means, and having a socket in which part of said prod portion is receivable; and a transverse detent constituting said locking means, said detent being carried by the inner of said telescoping sections, said detent being engageable with apertures in the outer of said telescoping sections, and additionally including means mounted on said outer section providing an interior annular recess engageable with said detent means to limit the possible extension of said telescoping sections.

5. A marine implement including a boat hook having an elongated handle portion extending along a handle axis, a hook portion extending laterally from said axis, and a prod portion extending parallel to said axis on the opposite side of said hook portion from said handle portion, wherein the improvement comprises:

coupling means on said prod portion coaxial therewith, said prod portion having a point extending substantially beyond said coupling means; and at least one attachment engageable with said coupling means, and having a socket in which part of said prod portion is receivable, said attachment including a loop frame disposed with the axis thereof in a plane substantially parallel to said handle axis, and a plurality of projections from said loop frame extending laterally from said plane on at least one side thereof.

6. An implement as defined in claim 5, wherein said projections diverge with increased distance from said plane.

7. A marine implement for use in mooring procedures, said implement comprising:

a loop frame having an axis disposed substantially in one plane;

handle means extending from said loop frame substantially parallel to said plane; and line-retaining means fixed with respect to said loop frame whereby a loop at the end of a line may be retained on said line-retaining means by application of tension in said line in the direction of said handle, said line-retaining means including a plurality of projections extending from said plane on one side thereof.

* * * * *